US006789864B2

(12) United States Patent
Phillips

(10) Patent No.: US 6,789,864 B2
(45) Date of Patent: Sep. 14, 2004

(54) SYSTEMS AND METHODS FOR REFILLING PRINTING CARTRIDGES

(75) Inventor: Quintin T. Phillips, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/218,272

(22) Filed: Aug. 13, 2002

(65) Prior Publication Data

US 2004/0032442 A1 Feb. 19, 2004

(51) Int. Cl.[7] ..... B41J 2/175
(52) U.S. Cl. ..... 347/7; 399/27
(58) Field of Search ..... 347/7, 19; 399/12, 399/24, 27

(56) References Cited

U.S. PATENT DOCUMENTS 5,068,806 A * 11/1991 Gatten ..... 358/1.14
5,365,312 A * 11/1994 Hillmann et al. ..... 399/12
5,572,292 A * 11/1996 Chatani et al. ..... 399/25
5,636,032 A * 6/1997 Springett ..... 358/296
6,155,664 A * 12/2000 Cook ..... 347/7
6,257,711 B1 7/2001 Higuma et al.
6,257,713 B1 7/2001 Ahn
6,310,635 B1 10/2001 Coudray et al.
6,338,552 B1 1/2002 Sato et al.
6,364,449 B1 4/2002 Takahashi et al.
6,364,473 B1 4/2002 Liu
6,366,742 B1 * 4/2002 Reihl et al. ..... 399/12
6,386,691 B1 5/2002 Liu
6,390,590 B1 5/2002 Hansburg
6,467,888 B2 * 10/2002 Wheeler et al. ..... 347/85
2002/0015066 A1 * 2/2002 Siwinski et al. ..... 347/19

FOREIGN PATENT DOCUMENTS

EP 985537 A1 * 3/2000 ..... B41J/2/175

* cited by examiner

*Primary Examiner*—Lamson Nguyen
*Assistant Examiner*—Blaise Mouttet June

(57) ABSTRACT

A method of printing cartridge maintenance including determining remaining useful life of a printing cartridge, and refilling at least a portion of the printing cartridge if the remaining useful life is above a predetermined threshold.

27 Claims, 7 Drawing Sheets

SYSTEMS AND METHODS FOR REFILLING PRINTING CARTRIDGES

BACKGROUND

Modern printing devices such as printers, copiers, and fax machines use certain materials that are consumed in the operation of the device. Examples of such materials are toner and ink. The device manufacturer will normally provide such materials in a disposable printing cartridge that is discarded when these materials are consumed. Often such cartridges also contain one or more components, such as a thermal inkjet print head, that have a limited lifespan in the operation of the printing device.

However, while the lifespan of the hardware components of the cartridge is limited, this lifespan will normally exceed the supply of consumable material available in the cartridge. Additional margin is also sometimes provided due to the various printing modes used by customers. For example, a customer who typically prints a succession of single page jobs will wear out a laser printer's photoconductor drum (OPC) much faster than a customer who normally prints larger jobs of 20 pages or more.

Thus, a cartridge designed to meet the needs of both types of customers may be capable of effective use even after the original supply of consumable substance is exhausted.

In many markets for printing devices, the printing cost per page is an important factor in the purchase decision of the disposable cartridge. Because of the desire to reduce the average printing cost per page, toner or ink cartridges are sometimes refilled by consumers with after-market tools and materials. Often the materials available in the after-market products are not manufactured to the same standards as the original materials used in the cartridge. Additionally, some consumers continue to refill and use cartridges beyond their intended useful life.

Refilling disposable cartridges can result in many printing problems including loss of definition, increased leakage, and printer damage or cartridge failure. These quality issues will often impact the reputation of the printing product.

To deal with the problems associated with refilling disposable cartridges, some attempts have been made to prevent the use of printing cartridges when the original supply of consumable substance is exhausted. However, as discussed above, often there is useful life remaining for the cartridge hardware when the consumable substance is exhausted, which cannot be effectively utilized by present methods

BRIEF DESCRIPTION OF THE SEVERAL VIEWS OF THE DRAWINGS

The foregoing and other features and aspects of the invention will become further apparent upon reading the following detailed description and upon reference to the drawings in which.

Figure 1:
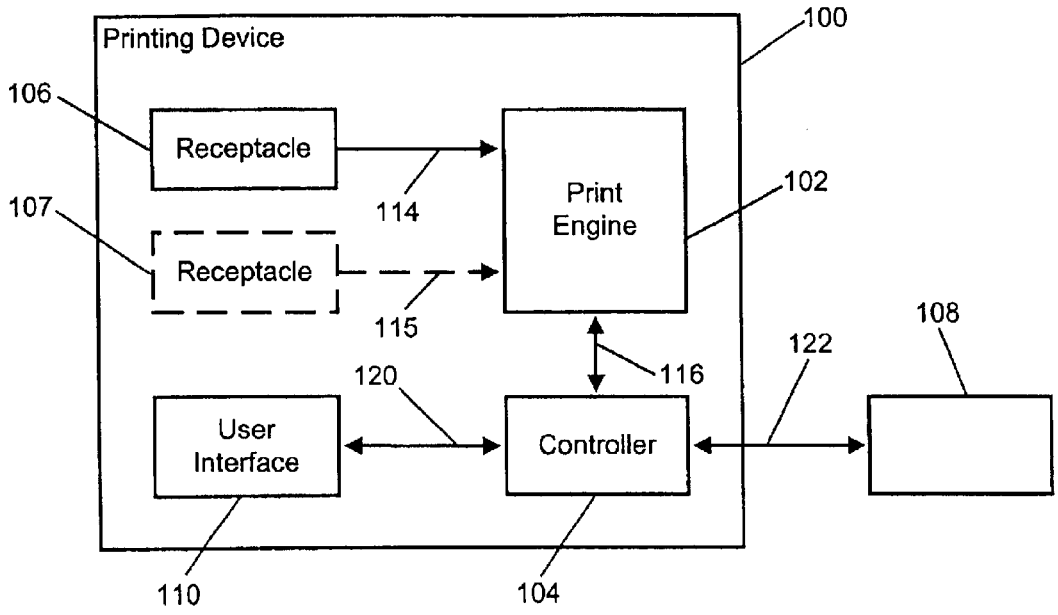
FIG. 1 illustrates a representation of a printing device according to one embodiment.

Throughout the drawings, identical reference numbers indicated similar, but not necessarily identical, elements. While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

The following specification describes, among other things, a system for refilling print cartridges with toner or ink. It will be appreciated that the terms ink and/or toner may be used interchangeably herein; the appropriate material—ink or toner—being applied to the corresponding technology for marking.

Turning now to the drawings, and in particular to FIG. 1, a representation of a printing device 100 according to one aspect of the present invention is shown. Printing device 100 may include, but is not limited to, a printer, a copier, a facsimile machine, a plotter, and the like. Printing device 100 includes a print engine 102 containing all of the physical and electrical components necessary to print an image onto media.

Print engine 102 may include electrostatic, inkjet, LED, dye sublimation, dot matrix, or other printing technologies available to those of skill in the art having the benefit of this disclosure. Printing device 100 also includes a controller 104, which includes all of the necessary electronics to provide control of print engine 102 via an interface 116.

Printing device 100 may also include one or more printer receptacles, shown in the present embodiment as receptacles 106 and 107, for receiving a printing cartridge containing a supply of consumable substance used to print on a media page. One receptacle may be used to receive a cartridge containing one or more of a variety of colored inks, while the other receptacle receives a cartridge containing only black ink. It will be understood that in some embodiments there may be only one receptacle for receiving a printing cartridge, typically a cartridge of black ink in a non-color printer. Printing receptacles 106 and 107 may include channels 114 and 115, respectively, for transferring consumable substances to print engine 102 when a cartridge is coupled to printing device 100.

A communications interface 122 may be included in printing device 100 to facilitate communications between controller 104 and any other electronic device 108. Electronic device 108 may include a computer, workstation, network controller, modem, or other device that may provide printing instructions to printing device 100.

Printing device 100 may also include a user interface 110 for allowing local operator control of printing device 100 via a communications interface 120 to controller 104. User interface 120 may include, but is not limited to, buttons, a touch-screen, a keyboard, a keypad, a port, or any other convenient user interface.

Figure 2:
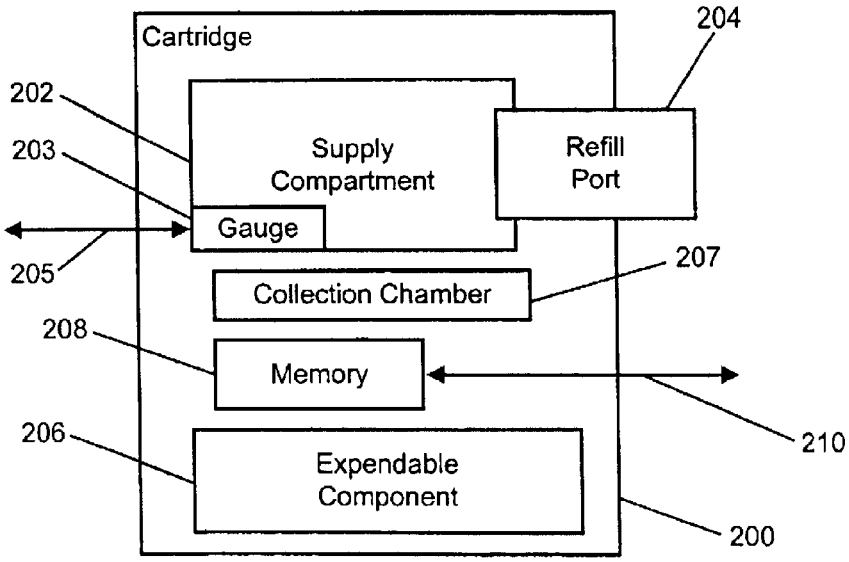
FIG. 2 illustrates a representation of a disposable cartridge according to one embodiment.

As mentioned above, receptacle 106 receives a printing cartridge such as printing cartridge 200 shown in FIG. 2. Printing cartridge 200 is a disposable printing cartridge and includes a consumable substance supply compartment 202 that is designed to contain a particular consumable substance used in the operation of a printing device. Cartridge 200 may include, but is not limited to, an inkjet cartridge for use in an inkjet printer, or a toner cartridge for use in a laser printer, copier, facsimile machine, or other device. In an embodiment where cartridge 200 is an inkjet cartridge, the inkjet cartridge may also comprise print engine 102 of printing device 100. The consumable substances may be used in the operation of printing device 100 to form an image on a print media. In addition to ink and toner, the particular consumable substance used may also include, but is not limited to: lubricants, conditioners and cleaning agents.

Consumable substances may be directly delivered to the print media, as is the case with ink in thermal or piezo ink jet printers, or indirectly delivered to the print media, as is the case with toner in laser printers, copier, and facsimile machines. Consumable substances may also be delivered to components of the printing device, as would be the case for lubricants, cleaners, belt conditioners, and the like.

As discussed above, printing cartridges such as cartridge 200 have a limited useful operational life. The length of the useful operational life of the cartridge may be impacted by a number of factors. Most often, the cartridge contains one or more components (represented generally by element 206) which have a limited operational lifespan. The component with the shortest operational lifespan defines the useful operational life of the cartridge. Components 206 that may define the lifespan of a cartridge include, for example, a print head in an inkjet cartridge, or the OPC drum, seals, and/or bearings in a laser printer toner cartridge. Other components and electronics may also limit cartridge lifespan.

As also discussed above, when the useful operational life of a cartridge such as cartridge 200 expires and a consumer finds a way to refill the cartridge anyway, the performance of the cartridge may be degraded in some way. For example, after a certain amount of use, the jets of an inkjet print head will cease to fire leaving stripes of unprinted space on the media. However, in many cases, when the originally supply of consumable substance is exhausted there is still remaining useful life for the cartridge. A user may take advantage of the remaining useful life by implementing the principles and systems described herein. According to one embodiment, the cartridge tracks usage information in order to take advantage of remaining cartridge life. Tracked usage information may be read, for example, by a refilling station capable of refilling the cartridge one or more times until usage meets or exceeds a prescribed level.

Therefore, in order to take advantage of the remaining useful life of cartridge 200, the cartridge includes an accessible refill port 204 and a memory device 208. Memory device 208 may record usage data that can be read, for example, by a refilling station 400 (shown in FIG. 3). Usage information recorded by memory device 208 can be compared to known values of cartridge life by refilling station 400 or other devices. If it is determined from reading the usage data on memory device 208 that cartridge 200 still has remaining useful life, then the cartridge may be at least partially refilled for continued use via refill port 204.

Refill port 204 may include one or more apertures through which consumable substance may be added to supply container 202. According to some embodiments, cartridge 200 may have more than one consumable substance in multiple supply containers 202, with at least one aperture incorporated into refill port 204 per consumable substance type. Supply container 202 may also include a gauge 203 for measuring and reporting the level of consumable substance in the supply container.

Other embodiments of the invention may include a cartridge containing more than one consumable substance in multiple supply containers (similar to containers 202), but with a single aperture incorporated into refill port 204. In such embodiments, consumable substances may be supplied differentially to the multiple supply containers. Therefore, a controller to deliver each substance type to its corresponding supply container may operate the single aperture.

In some embodiments, cartridge 200 may include a consumable substance collection chamber 207. Collection chamber 207 may be used to collect toner or another consumable substance that is discharged from supply container 202, but not effectively used in operation (i.e., wasted consumable substance). Collection chamber 207 may be emptied as part of a reconditioning of the cartridge at the time of refill, as necessary.

According to the embodiment of FIG. 2, refilling of supply container 202 is only permitted if there is useful life remaining for cartridge 200 above a predetermined threshold. Therefore, to facilitate the determination of remaining useful life of cartridge 200, the cartridge includes a memory device such as non-volatile memory 208. As discussed above, non-volatile memory 208 provides storage for printing history data or usage information associated with the cartridge. Non-volatile memory 208 may include a memory chip. Memory chips that may be used for storing printing history data are widely available from Hewlett-Packard, Dallas Semiconductor, and other sources. Non-volatile memory 208 may also include an RFID (radio frequency identification) memory device that does not require electrical contacts to send and/or receive printing history data. RFID memory devices are available from Texas Instruments and other suppliers. In embodiments employing an RFID, printing device 100 may include a transmitter and/or receiver (or a transceiver) for sending and/or receiving data from the RFID.

"Non-volatile memory" as used in this disclosure means that the contents of the memory are preserved if the cartridge is removed from the printing device. Access to non-volatile memory 208 is provided by a memory interface available to other devices. The necessary form of the memory interface is dependent on the type of non-volatile memory. Examples of such memory interfaces are an electrical connector and wires for an electronic memory, a defined position on the body of the cartridge for magnetic or optical memory, or a radio transceiver for an RFID. The recording of usage information may be performed by the cartridge, by a component of the printing device, or by another device.

Printing history data may include usage information, manufacturing information, and other information as desired. Access to memory 208 is provided to external devices via a bi-directional memory interface 210, which may include RF antennas, receivers, transmitters, optical equipment, wiring, or other interfaces depending on the specific type of memory chosen.

Printing history data may include information that is gathered according to usage metrics to facilitate the determination of remaining useful cartridge life. Many usage metrics can be measured and recorded to monitor the use of the consumable cartridge with reasonable accuracy. Examples of metrics that can be monitored and recorded in memory 208 include, but are not limited to: time in operation, quantity of consumable substance delivered, number of pages produced, the product of the substance delivered times the number of pages printed, the number of cleaning or calibration cycles, the time above a specific temperature, the age of the cartridge from manufacture date, or other usage metrics.

A "known" useful operational life value associated with any or all of the usage metrics is chosen or determined for comparison with the measured metric usage data recorded on memory 208. The comparison of known metric values to measured metric usage may be used to calculate the remaining useful life of cartridge 200. In some embodiments, the known useful operational life values are stored in memory 208, however, the known useful operational life values may also be stored external to cartridge 200 in the memory of a computer or other device such as refill station 400 (discussed with reference to FIG. 3 below).

Figure 3:
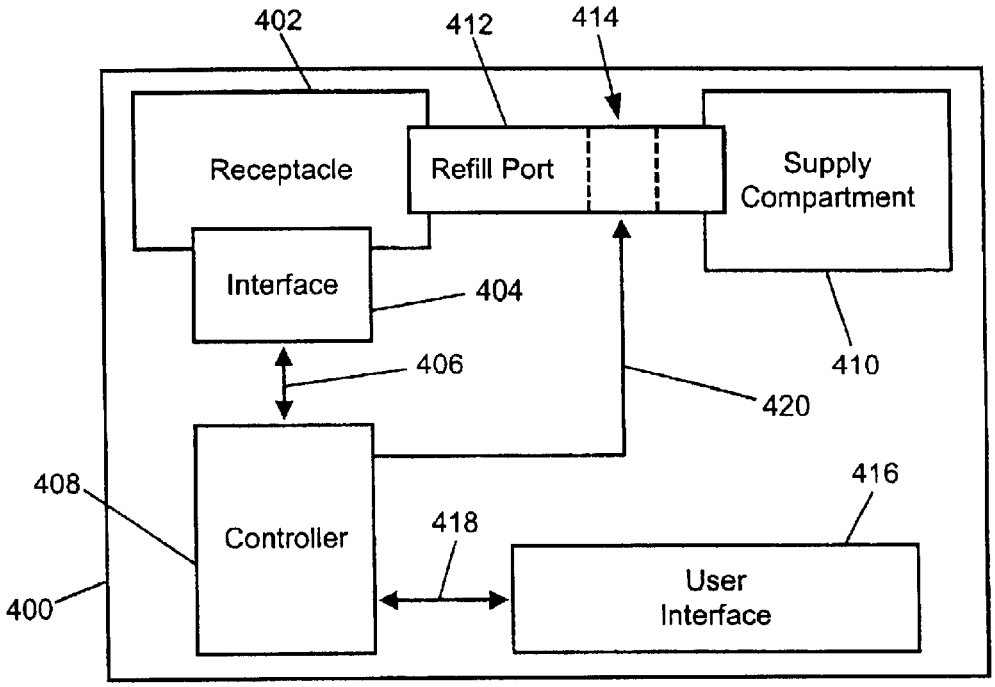
FIG. 3 illustrates a representation of a refilling station according to one embodiment.

Referring next to FIG. 3, a representation of a computerized refilling station 400 according to one embodiment of the present invention is shown. According to the embodiment of FIG. 3, computerized refilling station 400 includes a cartridge refill receptacle 402 that is receptive of a cartridge such as cartridge 200 shown in FIG. 2. Receptacle 402 may be adapted to receive any cartridge type, including inkjet cartridges, toner cartridges and the like.

Computerized refilling station 400 may also include a controller 408 that performs the necessary control functions of the refilling station. The control functions performed by controller 408 may include the reading of printing history information from non-volatile memory 208 as shown in FIG. 2. Controller 408 may also perform a determination of the remaining useful life of cartridges by comparing printing history information read from the cartridge memory to predetermined "known" values, as discussed above. Based on the determination of remaining useful life, controller 408 may selectively generate signals intended to either cause a refilling delivery port 412 to deliver a supply of consumable substance from a supply compartment 410 to the cartridge, or to prevent cartridge 200 from being refilled.

The control functions carried out by controller 408 may be embodied in software or firmware contained by controller 408. A receptacle interface 404 provides a communications channel from controller 408 to cartridge memory through a memory interface, for example element 210 described above. Lines of communication 406 represent the communication path between controller 408 and a cartridge in receptacle 402. Receptacle interface 404 may include a simple connector, or may include other devices such as a read/write head, a radio transceiver, or an optical transceiver as required to communicate with a cartridge memory through the cartridge memory interface.

Receptacle 402 is designed such that delivery port 412 mates with a consumable cartridge and can deliver the consumable substance to supply containers such as container 202 as shown in FIG. 2. The delivery of the consumable substance through delivery port 412 may be enabled or disabled (and locked out) by a delivery controller 414. Delivery controller 414 may be a valve or other mechanism to control the delivery of consumable substance through delivery port 412. Delivery controller 414 is itself activated via a control signal 420, which may be output by controller 408. Computerized refilling station 400 may also include a user interface 416 and communications path 418 to provide operator interaction with the refilling station.

Operation of computerized refilling station 400 may be described as follows. As a consumable cartridge such as cartridge 200 is used, printing history information relating to cartridge use is automatically collected and written to the cartridge memory. The printing history information, which may be gathered in terms of usage metrics, may be tracked and written by a printing device component such as printing device controller 104, by a cartridge controller such as controller 612 (discussed below with reference to FIG. 4), or by another device.

Eventually, the supply of consumable substance in cartridge 200 may become depleted and a user may wish to refill the consumable substance in the cartridge. According to the present invention, the cartridge may be removed from the printing device and inserted into a refill receptacle, such as receptacle 402 of computerized refilling station 400.

Upon insertion of cartridge 200 into computerized refilling station 400, computerized refilling station 400 may then read data recorded on cartridge 200 and determine whether or not there is remaining useful operational life for the cartridge. If there is no remaining useful life, refilling is not allowed and a user may receive an indicator that the cartridge must be replaced. However, if computerized refilling station 400 determines that there is remaining useful life for the cartridge above a predetermined threshold (which may, in some embodiments, be any value above zero), the cartridge may be at least partially refilled.

To determine remaining useful life of a cartridge such as cartridge 200, computerized refilling station 400 may compare the printing history data read from the memory of cartridge 200 to predetermined or known metric values relating to cartridge component lifespan (which may include the metrics discussed above). If none of the printing history data indicates a value equal to or greater than the predetermined metric values, at least a partial refill may be allowed.

The predetermined or known metric values may be made available to the computerized refill station 400 at the time the cartridge is presented for refilling by one of a number of methods. Examples of such methods include, but are not limited to: writing the values in the non-volatile memory of the cartridge at the time of manufacture, or including the value in software or firmware installed on the refill station.

According to one aspect of the present invention, if the refill station 400 determines there is remaining useful life above a predetermined threshold, the amount of consumable substance to add to the cartridge may be determined from an equation. A simple example of such an equation may be:

$$Sr=Sc-Su$$

where:

Sc is the amount of substance that may be used throughout the life of the cartridge, Su is the amount of substance used to date through the cartridge, and Sr is the amount of substance to refill not greater than the cartridge capacity.

Other equations to determine the refill amount of consumable substances may also be used. For example:

$$Sr=K*(Rc-Ru)*Pcl(Ru)$$

where:

Sr is the amount of substance to refill,

Rc is the usage capacity of a resource,

Ru is the amount of usage of the resource,

K is a scalar relating the resource usage to substance consumption, and Pcl is a probability function reducing Sr on the basis of a statistical confidence level.

The use of still other equations to determine a refill amount may also be developed by those of skill in the art having the benefit of this disclosure.

In order to prevent overfilling, the refilling station may include or have access to a database of cartridge capacities. The refilling station may also monitor the amount of consumable substance delivered to the cartridge. In addition, the cartridges may have gauges such as gauge 203 that is capable of sending a fill level signal to the computerized refilling station 400. Gauge 203 may facilitate terminating the delivery of the consumable substance to the cartridge when it reaches a certain level. Gauge 203 may include an interface 205 to communicate a fill level to refilling station 400. Cartridge consumable substance gauges may include, but are not limited to: light reflectance sensors, ultrasonic transmitter and detectors, and weight scales. Alternatively, refill port 204 may include automatic mechanisms that shut off delivery when the cartridge is full.

If a cartridge such as cartridge 200 is at least partially refilled, the amount of consumable substance added to the cartridge may be recorded to the cartridge memory 208. This information may be useful, for example, to evaluate the rate of substance consumption to printer use over a number of printer specimens.

In addition to refilling the cartridge, cartridge 200 may be partially reconditioned as well. For example, collection chamber 207 of cartridge 200 may be emptied when cartridge 200 is at least partially refilled to ensure that the chamber does not overfill after supply compartment 202 is replenished. Collection chamber 207 may be emptied, for example, by tilting and dumping cartridge 200, by blowing a supply of compressed air through the compartment, or by other methods.

When cartridge 200 has been at least partially refilled by computerized refilling station 400, the cartridge may then be reinstalled into a printing device for further use.

Figure 4:
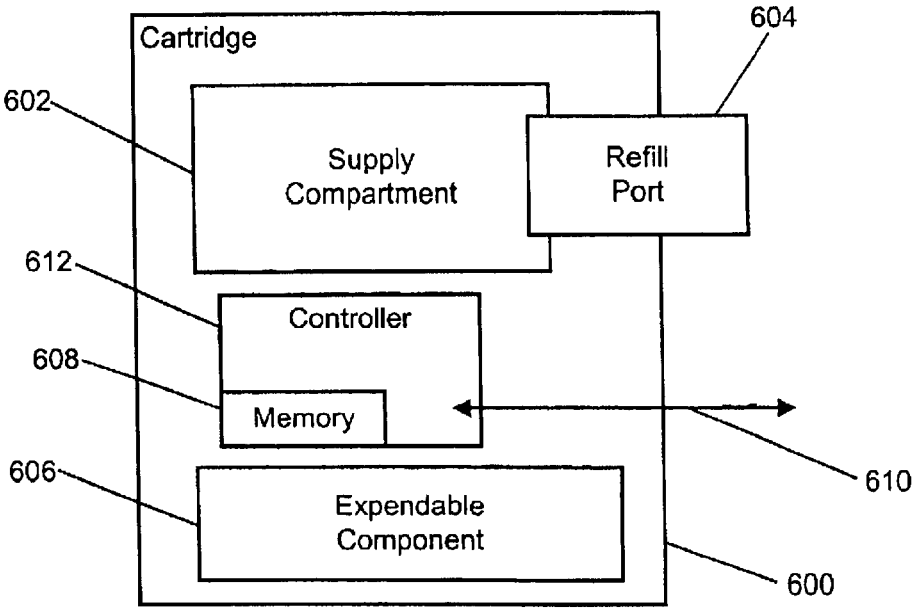
FIG. 4 illustrates a representation of a disposable cartridge according to another embodiment.

An alternate embodiment of a consumable cartridge 600 is shown in FIG. 4. According to the embodiment of FIG. 4, there is a supply compartment 602 and a refill port 604 that serve similar functions to those of elements 202 and 204 described in connection with FIG. 2. Consumable cartridge 600, however, may also include a controller 612 for monitoring the use of cartridge 600 and writing usage information to memory 608. Controller 612 may be desirable for tracking printing history directly by the consumable cartridge.

According to the embodiment of FIG. 4, memory 608 may be accessed by external devices through a memory interface 610. Access to memory 608 may also be provided indirectly through controller 612 if desired.

Expendable component 606 represents any component of cartridge 600 that may have a shorter operational lifespan than supply compartment 602, aperture set 604, memory 608, and controller 612. Expendable component 606 is similar to element 206 of FIG. 2.

Figure 5:
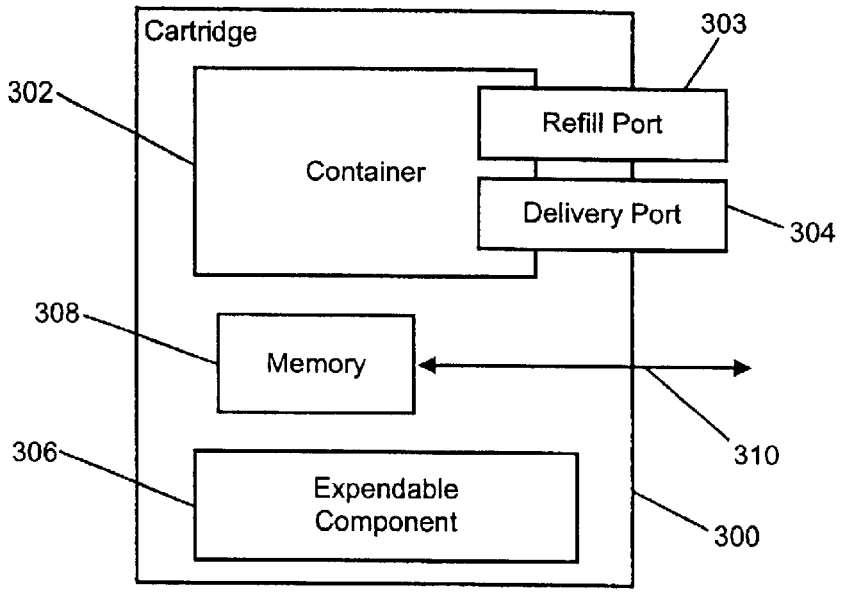
FIG. 5 illustrates a printing cartridge according another embodiment.

Turning next to FIG. 5, another embodiment of a printing cartridge 300 is shown. According to the embodiment of FIG. 5, there may be two distinct sets of ports: refill port 303 and delivery port 304. Both refill port 303 and delivery port 304 may include one or more apertures. Refill port 303 provides access to refill supply container 302 for housing a consumable substance, and delivery port 304 provides a structure to deliver the consumable substance to a printing device such as printer 100. Supply compartment 302, expendable component representation 306, memory 308, and memory interface 310 serve similar or identical functions to those of similarly labeled elements shown in FIG. 2.

Figure 6:
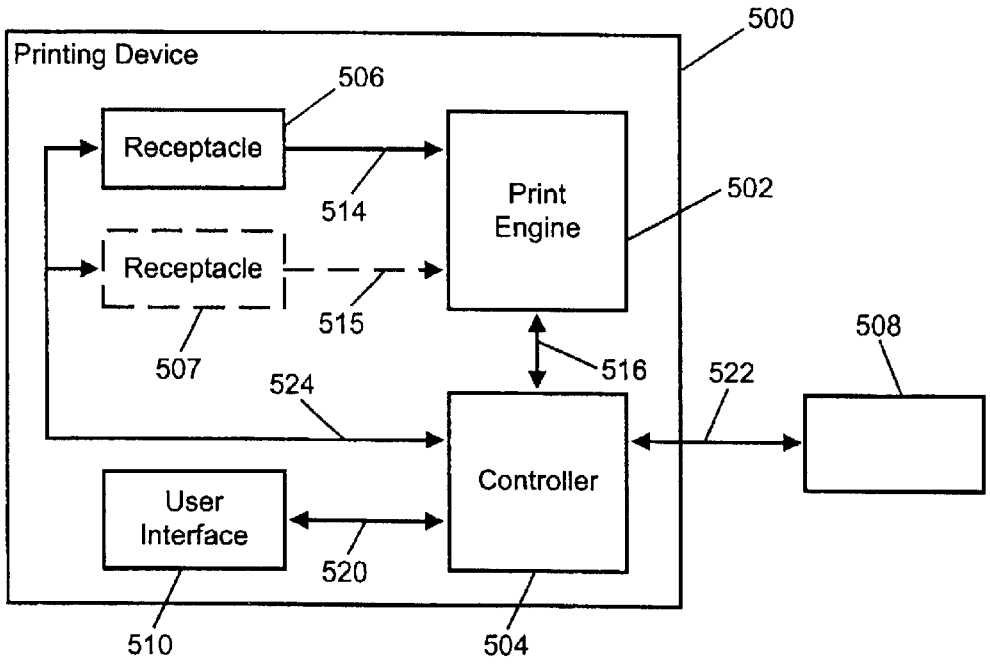
FIG. 6 illustrates a representation of a printing device according to another embodiment.

An alternate embodiment of a printing device 500 is shown in FIG. 6. Printing device 500 may include a print engine 502, a controller 504, and an interface 516 for facilitating control of print engine 502. Printing device 500 may also include cartridge receptacles 506 and 507 designed to receive cartridges such as cartridges 200, 300, or 600. When cartridges such as cartridges 200, 300, or 600 are inserted into receptacles 506 and/or 507, one or more consumable substances may be delivered through channels 514 and 515 to print engine 502. Communications interface 522 is provided for communications between another electronic device 508 and controller 504. User interface 510 and interface 520 may be provided for operator control of printing device 500. Communications channel 524 provides communications between controller 504 and cartridge memory, such as memory 208, 308, and/or 608. Communications between controller 504 and cartridge memory 208, 308, and/or 608 may be facilitated by memory interface 210, 310, and 610. When a consumable cartridge is mated to receptacle 506 or 507, controller 504 is capable of writing to the cartridge memory via communications channel 524.

Figure 7:
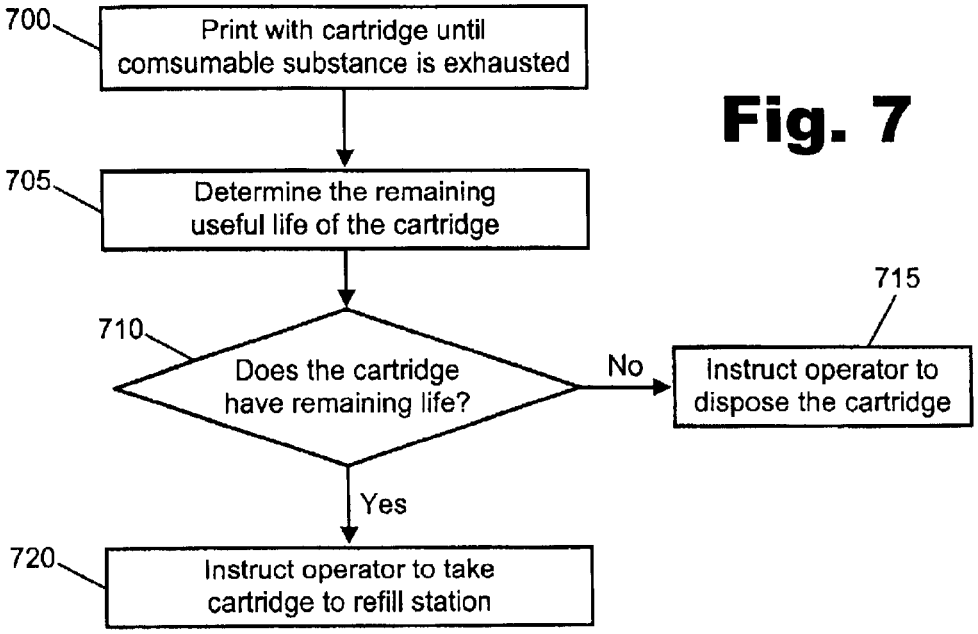
FIG. 7 illustrates a flow chart of a refilling sequence according to one embodiment.

Turning next to FIG. 7, there is a flowchart illustrating another operational cartridge refill procedure according to one aspect of the present invention. According to the flowchart of FIG. 7, an operator may be informed when it is appropriate to refill a cartridge (such as cartridge 200, 300 and 600). This procedure and the procedure illustrated by FIG. 8 may be implemented by software or firmware contained in printing device 100, or by software or firmware located external to the printing device in a printer driver installed on a host computer or other device.

According to the aspect of the invention shown in FIG. 7, a cartridge is used normally in the course of printing while installed in a receptacle such as receptacle 106 and/or 107 in a printing device. As shown at step 700, the consumable substance will eventually become depleted or exhausted. When this occurs, the remaining useful life of the cartridge is determined in terms of usage metrics, as shown at step 705. The determination of remaining useful life may be made by software on the printing device, or by a computer or other device capable of making comparisons. The decision point 710 directs the action of the software to step 720 if there is useful life remaining above a predetermined threshold, for example if there is enough useful life remaining to print ten, fifty, one-hundred, or more pages of documents.

If the cartridge has been used to or beyond its useful life, the program proceeds to step 715 and the operator is instructed to dispose the cartridge, which might include discarding the cartridge, shipping the cartridge to a recycling facility, or other appropriate actions. However, when there is useful cartridge life remaining, the operator is instructed to take the cartridge to a refill station such as refilling station 400 for replenishment of the consumable substance.

Figure 8:
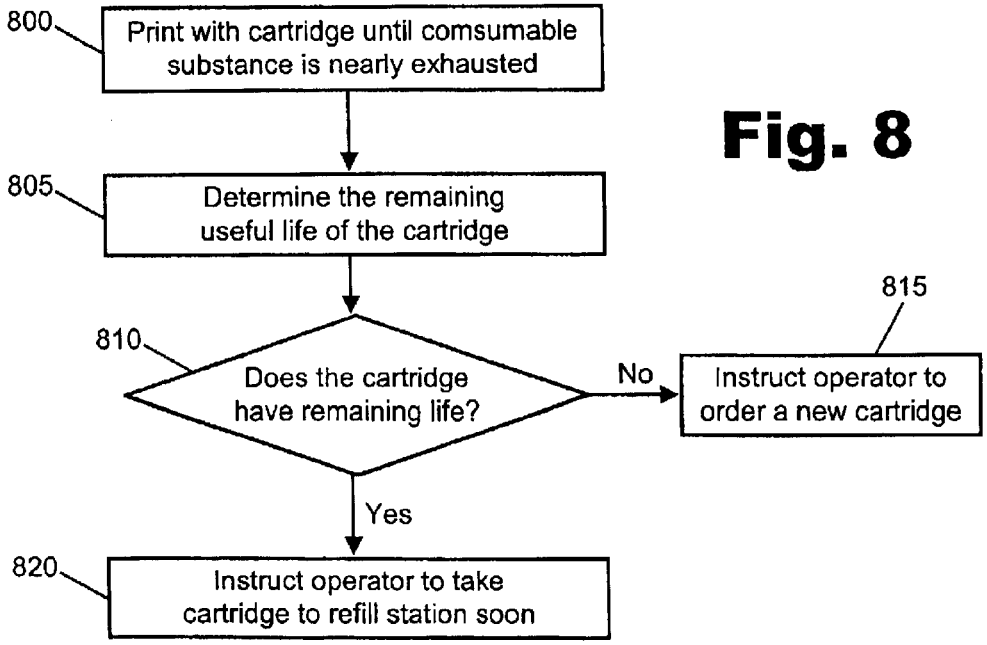
FIG. 8 illustrates a flow chart of a refilling sequence according to another embodiment.

FIG. 8 shows by flowchart another operational refilling procedure according to one embodiment of the present invention. According to the embodiment of FIG. 8, an operator may receive refilling instructions when the consumable substance is nearing depletion, as represented by box 800. A predetermined threshold value may be chosen that will trigger the step of determining remaining cartridge life. Such a threshold may be, for example, when the consumable substance supply reaches a one-quarter, one-eighth, or other level nearing complete exhaustion. Other triggers may also be used to initiate the determination of remaining cartridge life including, but not limited to, a timer, a number of pages printed, a number of calibration cycles completed, or other trigger.

When the predetermined threshold trigger value is reached, the remaining useful life of the cartridge may be determined in terms of usage metrics, and is represented as box 805. An allowance to the remaining useful life may be made, if desired, for the amount of consumable substance remaining in the cartridge, making an appropriate adjustment to the remaining life of the cartridge. The determination of the amount of consumable substance that remains in the cartridge may be performed in a number of ways including, but not limited to: sensing from gauges and/or estimating from usage information. A decision point 810 directs the action of the software to step 815 if the useful life of the cartridge, as determined in step 805, is exhausted. Otherwise, execution continues to step 820.

Step 815 instructs the operator to order or otherwise obtain a new cartridge, giving the operator advanced notice that the present cartridge is about to expire and allowing the operator time to obtain a new cartridge. Step 820, on the other hand, instructs the operator to refill the cartridge, giving the operator advanced notice that the present cartridge is about to be exhausted and allowing the operator to refill the cartridge when convenient.

The procedure of FIG. 8 may be repeated at some future event, such as completion of a document or expiration of a timer, to remind the operator that the cartridge will need attention soon.

Figure 9:
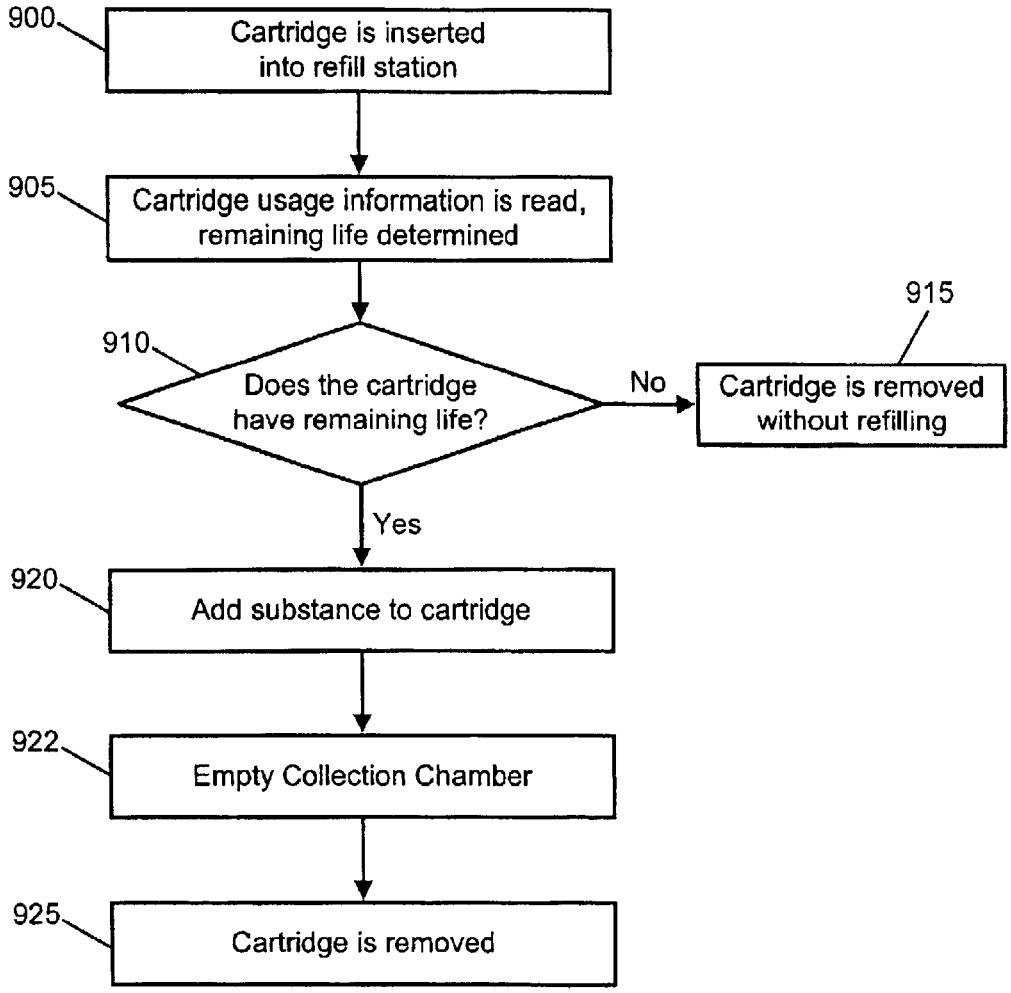
FIG. 9 illustrates a flow chart of a refilling sequence according to another embodiment.

FIG. 9 shows by flowchart the operation of a refill station such as refilling station 400 according to another aspect of the present invention. At box 900, a cartridge such as cartridge 200, 300 or 600 may be inserted into refill station 400, and is mated to a receptacle such as receptacle 402. The refill station then reads the usage information from cartridge memory (examples of which are described with reference to elements 208, 308, and 608) and determines the remaining useful life of the cartridge in terms of usage metrics, as represented by box 905. An allowance to the remaining useful life may be made, if desired, for the amount of consumable substance remaining in the cartridge. A decision step 910 may be made directing the refill station to execute step 915 if the cartridge useful life has been exhausted, or step 920 otherwise. If step 915 is executed, the cartridge is not refilled, and the cartridge is permitted to be removed from the refilling station. Otherwise, step 920 is executed, whereby consumable substance is added to the supply compartment of the cartridge (examples of supply compartments are shown as elements 202, 302, and 602). Before or after the cartridge is at least partially refilled, the cartridge may be reconditioned, for example cartridge collection chamber 207 may be cleaned or emptied as shown at step 922. The cartridge is eventually removed as shown by step 925.

Figure 10:
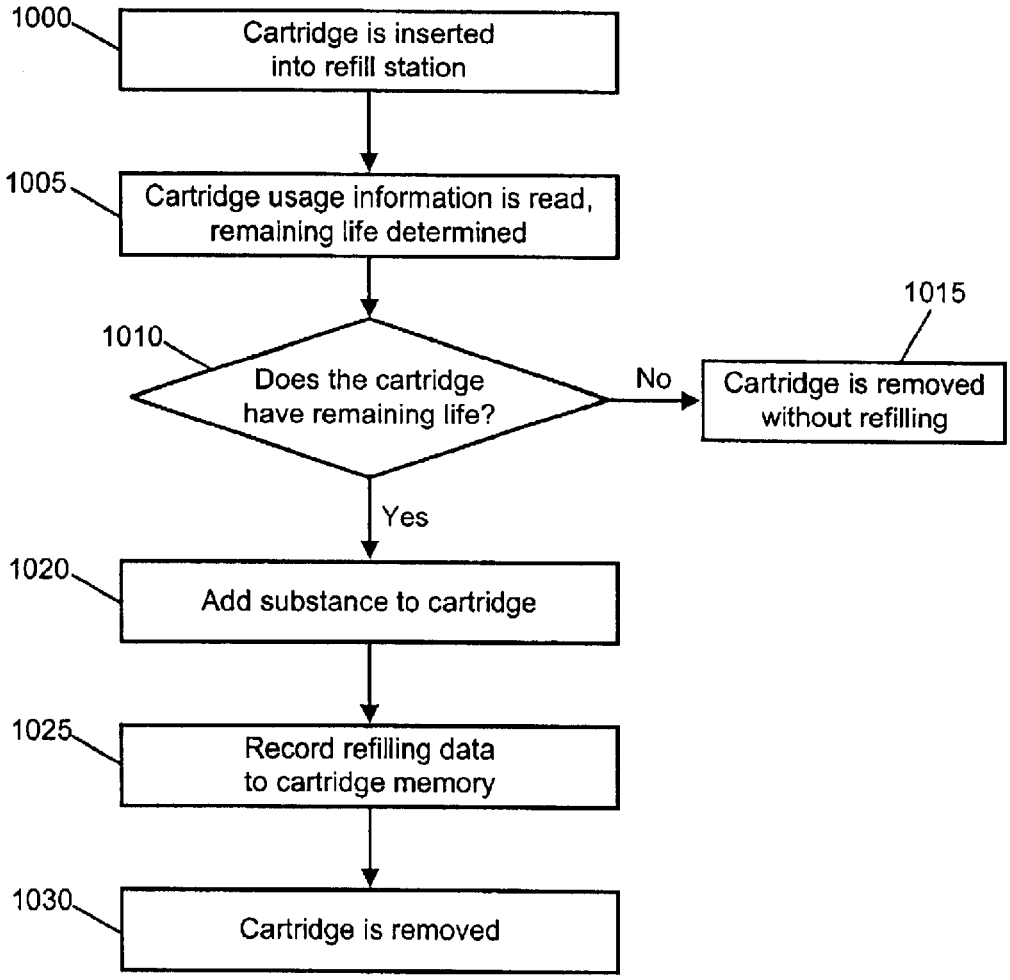
FIG. 10 illustrates a flow chart of a refilling sequence according to another embodiment.

FIG. 10 shows by flowchart another operation of a refill station according to one embodiment of the present invention. According to the embodiment of FIG. 10, steps 1000, 1005, 1010, 1015, 1020 and 1030 correspond similarly with steps 900, 905, 910, 915, 920, and 925, respectively, as described for FIG. 9. However, a step represented by box 1025 may be added where refill history information related to the refill operation is recorded to cartridge memory. Such information may include, but is not limited to, the amount of consumable substance replenished, the time of replenishment, an identifier of the refill station used or the cartridge refilled, or other data that may be related to the refill operation.

Figure 11:
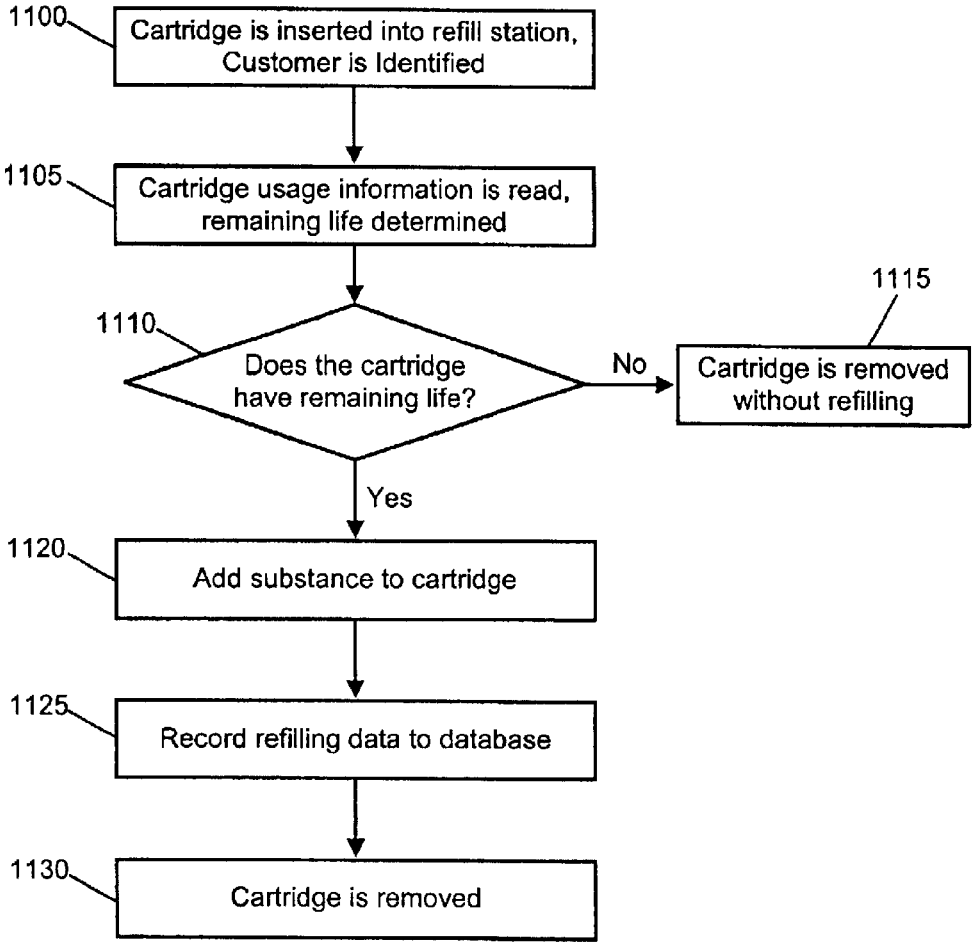
FIG. 11 illustrates a flow chart of a refilling sequence according to another embodiment.

FIG. 11 shows by flowchart an operation for a refill station such as station 400 where refill data is tracked to a database. Such data may be useful, for example, for billing purposes where many customers use a single refilling station at a central location on a per-use basis. According to the embodiment of FIG. 11, steps 1100, 1105, 1110, 1115, 1120, and 1130 are similar to steps 900, 905, 910, 915, 920, and 925 respectively, as described for FIG. 9. A cartridge such as cartridge 200, 300 or 600 may be inserted in to the refill station, as shown in step 1100. When the cartridge is inserted into the refill station, a customer identifier may be read from the cartridge.

According to the flow chart of FIG. 11 the refill station procedure may proceed operationally to determine remaining cartridge life, and if there is remaining useful life, to refill at least a portion of the cartridge. However, at the step represented by box 1125, information relating to the refill operation is recorded to the database. This information may include, but is not limited to, the customer identifier, the amount of substance replenished, the number of pages printed, the amount of substance used per page, the date of manufacture, and the date of latest replenishment.

The refilling information may then be uploaded to a billing system for charging users for refilling services. It will be understood by those of skill in the art having the benefit of this disclosure, however, that it is not necessary for the identity of the customer to become known at step 1100. The customer identifier may be made known at any time prior to recording refilling data. However, according to some embodiments, the customer may be identified before any consumable substance is added to the cartridge in order to prevent an unidentified person from obtaining a refill.

What is claimed is:

1. A method of printing cartridge maintenance comprising:

reading printing history data for said printing cartridge and a predetermined usage threshold stored in a memory device on said printing cartridge, determining a remaining useful life of a printing cartridge based on said printing history data for said cartridge and said predetermined usage threshold, and refilling at least a portion of said printing cartridge if usage of said cartridge, as determined from said printing history data, does not exceed said predetermined threshold.

2. The method of claim 1, further comprising recording any amount of consumable substance added to the printing cartridge in said memory device.

3. The method of claim 2, further comprising reading customer identification information recorded on said printing cartridge.

4. The method of claim 1, further comprising replacing or resetting said memory device after reading said printing history data.

5. The method of claim 1, further comprising preventing the refill of said printing cartridge if said remaining useful life is less than said predetermined threshold.

6. The method of claim 1, further comprising reconditioning said printing cartridge.

7. The method of claim 6, wherein said reconditioning comprises emptying or cleaning a collection chamber of said printing cartridge.

8. A refilling system for printing cartridges including a computerized filling station comprising:

a refill receptacle configured to receive a printing cartridge having a memory device attached thereto, said receptacle comprising an interface for interfacing with said memory device;

a supply of material which is consumed during operation of said printing cartridge, said supply being connected to said refill receptacle; and a controller for reading both printing history data and a useful life value that are recorded on said memory device on said printing cartridge, wherein said controller selectively refills at least a portion of said printing cartridge in response to a comparison of said printing history data and said useful life value.

9. The refilling system of claim 8, wherein said printing cartridge is an inkjet printer cartridge.

10. The refilling system of claim 8, wherein said printing cartridge is a toner cartridge.

11. The refilling system of claim 8, further comprising electronic instructions to determine an amount of said consumable material contained in said printing cartridge.

12. The refilling system of claim 11, further comprising a consumable substance gauge.

13. A device refilling system comprising:

a printing cartridge for containing a supply of consumable substance, wherein a gauge is disposed in said supply of a consumable substance and configured to output an indication of a quantity of said consumable substance remaining in said printing cartridge;

a memory device incorporated with said cartridge for recording a printing history of said cartridge; and a refilling station for reading information recorded on said memory device, receiving said indication from said gauge and selectively refilling said cartridge;

wherein said refilling station includes a computer for reading said printing history of said memory device and for determining a remaining useful life of the cartridge; and wherein said computer compares said printing history to one or more predetermined useful life metrics.

14. The system of claim 13, wherein said memory device comprises a non-volatile memory chip readable by a computer.

15. The system of claim 14, wherein said memory device comprises an RFID having an antenna for communication with a transmitter of a printing device or said refilling station.

16. The system of claim 13, wherein said refilling station prevents refilling of said cartridge if said computer determines said cartridge has no remaining useful life.

17. The system of claim 13, wherein said refilling station further comprises a supply of consumable substance.

18. The system of claim 17, wherein said filling station further comprises a consumable substance delivery port for refilling said cartridge.

19. The system of claim 18, wherein said cartridge further comprises a consumable substance refill port configured for engagement with said substance delivery port for receiving consumable substance from said refilling station.

20. The system of claim 19, wherein said cartridge further comprises an inkjet cartridge.

21. The system of claim 19, wherein said cartridge further comprises a toner cartridge.

22. The system of claim 21, wherein said toner cartridge is a laser printer toner cartridge or a copier toner cartridge.

23. The system of claim 13, wherein said printing history comprises one or more of; printing cartridge use time, quantity of consumable substance delivered, number of pages produced, number of pixels printed, number of cleaning cycles performed, number of calibrations cycles performed, types of jobs printed, age of printing cartridge from manufacture date; and cartridge time above a specified temperature.

24. A refilling system for printing cartridges including a computerized filling station comprising:

means for receiving and refilling a printing cartridge having a memory device attached thereto;

a supply of material which is consumed during operation of said printing cartridge, said supply being connected to said means for receiving and refilling;

means for reading and comparing both printing history data and a useful life value that are recorded on said memory device on said printing cartridge; and means for selectively refilling at least a portion of said printing cartridge with material from said supply in response to a comparison of said printing history data and said useful life value.

25. The refilling system of claim 24, wherein said printing cartridge is an inkjet printer cartridge.

26. The refilling system of claim 24, wherein said printing cartridge is a toner cartridge.

27. The refilling system of claim 24, further comprising means for cleaning a collection chamber of a printing cartridge, wherein said collection chamber collects material spilled in a printing cartridge.

* * * * *